US006713945B2

(12) United States Patent
Fuchs et al.

(10) Patent No.: US 6,713,945 B2
(45) Date of Patent: Mar. 30, 2004

(54) COOLABLE INFRARED RADIATOR ELEMENT OF QUARTZ GLASS

(75) Inventors: Stefan Fuchs, Niedernberg (DE); Friedhelm Schneider, Gelnhausen (DE); Joachim Scherzer, D-Bruchköbel (DE)

(73) Assignee: Heraeus Noblelight GmbH (DE)

( * ) Notice: Subject to any disclaimer, the term of this patent is extended or adjusted under 35 U.S.C. 154(b) by 28 days.

(21) Appl. No.: 09/932,287

(22) Filed: Aug. 17, 2001

(65) Prior Publication Data

US 2002/0024277 A1 Feb. 28, 2002

(30) Foreign Application Priority Data

Aug. 24, 2000 (DE) ..... 100 41 564

(51) Int. Cl.[7] ..... H01K 1/28; H01K 1/24

(52) U.S. Cl. ..... 313/113; 313/110; 313/634; 250/493.1; 250/504 R; 392/424; 392/435

(58) Field of Search ..... 313/35.36, 113, 313/112, 111, 110, 634; 250/504 R, 493.1, 494.1; 392/407, 408, 415, 422, 424, 435; 240/495.1

(56) References Cited

U.S. PATENT DOCUMENTS

| | | | | |
|---|---|---|---|---|
| 3,627,989 A | * | 12/1971 | Heidler et al. | 219/553 |
| 4,588,923 A | * | 5/1986 | Hoegler et al. | 313/579 |
| 4,598,194 A | * | 7/1986 | Halberstadt et al. | 219/459.1 |
| 4,839,559 A | * | 6/1989 | Ahlgren et al. | 313/579 |
| 5,091,632 A | * | 2/1992 | Hennecke et al. | 219/553 |
| 5,382,805 A | | 1/1995 | Fannon et al. | |
| 5,567,951 A | * | 10/1996 | Baschant et al. | 250/504 R |
| 5,867,630 A | * | 2/1999 | Kreuter et al. | 392/407 |
| 6,057,532 A | * | 5/2000 | Dexter et al. | 219/553 |
| 6,122,438 A | * | 9/2000 | Scherzer et al. | 392/411 |
| 6,399,955 B1 | * | 6/2002 | Fannon | 250/504 R |

FOREIGN PATENT DOCUMENTS

| | | |
|---|---|---|
| DE | 26 37 338 | 2/1978 |
| DE | 28 13 122 | 3/1987 |
| DE | 257 200 | 6/1988 |
| DE | 200 20 148 | 4/2001 |
| DE | 200 20 149 | 4/2001 |
| DE | 200 20 150 | 4/2001 |
| DE | 200 20 319 | 4/2001 |
| DE | 200 20 320 | 4/2001 |
| EP | 163348 | 12/1985 |
| EP | 999 724 | 5/2000 |
| FR | 2 362 488 | 3/1978 |
| GB | 15 31 406 | 12/1978 |
| WO | WO 00 49641 | 8/2000 |

* cited by examiner

*Primary Examiner*—Ashok Patel
*Assistant Examiner*—Sikha Roy
(74) *Attorney, Agent, or Firm*—Ostrolenk, Faber, Gerb & Soffen, LLP

(57) ABSTRACT

A coolable infrared radiator element of quartz glass with at least one heating tube, which has a gas-tight current lead-through at each of its two ends. A long, stretched-out electrical heating conductor in the heating tube serves as the radiation source. At least one cooling element is provided which has at least one cooling channel for a liquid coolant. A metal reflector is provided at least in the area of the heating conductor, which reflector has at least one reflective surface. The problem is to provide an infrared radiator which can deliver high energy concentrations of >500 kW/m$^2$ in conjunction with low radiation losses. The problem is solved in that at least one reflective surface, when seen in cross section, describes a line around a surface, where the opening for the passage of at least some of the liquid coolant is provided in the area of this surface.

16 Claims, 8 Drawing Sheets

C - C'
3a
3
8
1
9b 5b
10a
10b
1
4a
3
2a
C
C'
2b
9a
4b
5a
9b 5b
10a
3
2a
3a
4a
1
5a

COOLABLE INFRARED RADIATOR ELEMENT OF QUARTZ GLASS

BACKGROUND OF THE INVENTION

Field of the Invention

The invention relates to a coolable infrared radiator element of quartz glass with at least one heating tube, which has a gas-tight current lead-through at each of its two ends. A long, stretched-out heating conductor is provided in the heating tube to serve as the radiation source. At least one cooling element is provided which has at least one cooling channel for a liquid coolant and there is a metallic reflector with at least one reflective surface at least in the area of the heating conductor.

These types of infrared radiator elements are known from DE 2,637,338 C3. An infrared radiator element is disclosed here, which has a water-cooled twin tube of quartz glass comprising a heating tube and a cooling tube, where a reflective layer of gold is provided on a surface of the cooling tube. The reflective layer is applied either to the outside surface of the cooling tube or to the surface of the shared wall surface of the heating tube and the cooling tube facing away from the heating conductor. The energy concentration allowed for this radiator is 400 kW/m$^2$.

DD 257,200 A1 describes a high-power infrared radiation source, which has a long, stretched-out incandescent radiator in an envelope. The envelope is mounted inside a protective tube and offset by 3–15% relative to the protective tube in the plane of the radiation emission direction. A liquid cooling and filtering medium flows through the protective tube. On the surface facing the liquid medium, the envelope has several strips in the form of segments of a cylinder to serve as reflective surfaces. In contrast, the protective tube has a reflective layer in the approximate form of a half shell on the surface facing away from the liquid medium. To achieve maximum radiation output in the forward direction, three cylindrical segments are provided as reflective surfaces on the envelope; the distance between two cylinder segments is equal to the width of one of the segments, and one cylinder segment is parallel to the reflective surface on the protective tube.

EP 0,163,348 describes an infrared lamp with a coiled tungsten heating conductor in a quartz container. The quartz container is filled with a halogen gas to allow the halogen cycle to proceed. An infrared light-reflecting coating of gold or rhodium in the form of a half shell covers the surface of the quartz glass container, preferably extending over its entire length. Gas-tight current lead-throughs are provided in the quartz container in the form of thin pieces of molybdenum foil with electrical leads, pinched into the ends of the container.

DE 2,803,122 C2, finally, discloses a halogen incandescent filament lamp with a bromine cycle, where the lamp consists of a glass bulb of quartz glass, a filling gas, and a coiled tungsten filament. A metal bromide, which is introduced into the glass bulb in solid form, decomposes when the lamp is in the operating state; the bromine thus becomes available for the known tungsten-halogen cycle. Copper bromide is used here as the metal bromide.

SUMMARY OF THE INVENTION

The object of the present invention is to provide an infrared radiation source by means of which high energy concentrations of >500 kW/m$^2$ can be achieved in conjunction with relatively minor radiation losses.

The task is accomplished in that at least one reflective surface, when viewed in cross section, describes a line around a surface, the opening for the passage of at least some of the liquid coolant being provided in the area of this surface. "Cross section" means here a section perpendicular to the longitudinal axis of the heating tube, in which view the reflective surface can be seen only as a line. One of these lines should now, in cross section, enclose a surface. The line in this case is preferably a line which forms a circle, but other types of lines can also be used without difficulty such as lines which form a square, a rectangular, a triangular, an elliptical, a crescent-shaped, or other type of regular or irregular surface. Accordingly, at least one of the reflective surfaces recognizable in cross section forms a channel for the liquid coolant or least for a portion of it.

With this geometric design, it is possible to build a high-output infrared radiator with low radiation losses and energy concentrations of 1 MW/m$^2$. The heating tube must be designed in this case for a specific output of up to 190 W/cm, for which very high heating conductor temperatures in the range of approximately 3,000° K are required. At these high heating conductor temperatures, however, the stability of the quartz glass heating tube is at risk, while at the same time there is also a high probability that the cooling water will overheat or boil and thus that the radiator element will break. The stability of the quartz glass heating tube is achieved according to the invention by the use of a liquid coolant with a high heat absorption capacity, especially water in this case, to cool the tube. At the same time, the design of the reflector according to the invention prevents the coolant from heating up too much. Such overheating would happen if, for example, the reflective layer were to be provided on the external surface of a cooling tube, as already known according to the state of the art.

Now, however, there are different ways in which the special reflective surface can be provided.

For example, the reflector can consist of a layer of metal. The cooling element in this case can be a cooling tube with at least one cooling channel directly adjacent to the minimum of one heating tube, and at least one cooling channel is lined with the layer of metal. Gold coating on the inside surface of the cooling tube is preferably used here as the metal layer.

The reflector, however, can also consist of a thin-walled metal part. In this case, the cooling element consists of a cooling tube with at least one cooling channel directly adjacent to the minimum of one heating tube, and the cooling channel is lined with the metal part. The metal part can consist of a piece of foil or sheet metal. Foil, however, is more flexible and can be fitted more precisely to the internal dimensions of the cooling tube.

It is also possible for the reflector to consist of a thin-walled metal part, for the cooling element to be a cooling tube enclosing at least one heating tube, and for the thin-walled metal part to be mounted inside the cooling tube. A self-supporting reflector with a hollow structure can be preferably installed in the cooling tube, but also a combination of reflective layers on the cooling and/or heating tubes and a metal part can also be used.

A special embodiment involves a radiator in which the cooling element is designed as a metallic reflector. This means that a single component provides both the cooling property and the reflective property. As a result of the radiation impermeability of the reflector, this component should not enclose more than 50% of the circumference of the outer wall of the minimum of one heating tube. The reflector can have at least two cooling channels to transport the coolant.

It has been found effective for the heating conductor to be made of tungsten and for the heating tube to be filled with an inert gas doped with a halogen. Because a great deal of tungsten vaporizes at the high temperatures of a heating conductor, it must be doped with a halogen, preferably with ammonium bromide or copper bromide, so that a halogen cycle will go into effect. To prevent the ammonium bromide or copper bromide from condensing in the area of the electrical lead-throughs, an electrical connecting lead is provided between the heating conductor and the gas-tight current lead-throughs. The diameter of the connecting lead is selected so that the connecting lead heats to a temperature of 600–800° C. at a rated current as a result of its electrical resistance.

A heating conductor in the form of a carbon ribbon can also be used in place of a tungsten heating conductor. In this case, the heating tube is either filled with a noble gas or evacuated. The carbon ribbon can be stretched by a spring or coiled.

Especially preferred is an infrared radiator element which has a first and a second heating tube, where some of the wall surface of the first heating tube serves simultaneously as a wall surface of the second heating tube.

So that specially shaped parts or spaces can be heated up or kept heated with the infrared radiator element, the heating tube and the cooling element can be curved.

As a result of this curvature, the two gas-tight lead-throughs of the heating tube can point in the same direction and be set up parallel to each other. As a result, it is possible, for example, for the electrical connections for the infrared radiator element to be located on only one side of the furnace space. To ensure the stability of the quartz glass heating tube, the heating tube is also designed preferably with an inside diameter of 10–17 mm. In this regard, the ratio of the coil diameter of the coiled heating conductor to the inside diameter of the heating tube should be at least 1:3.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
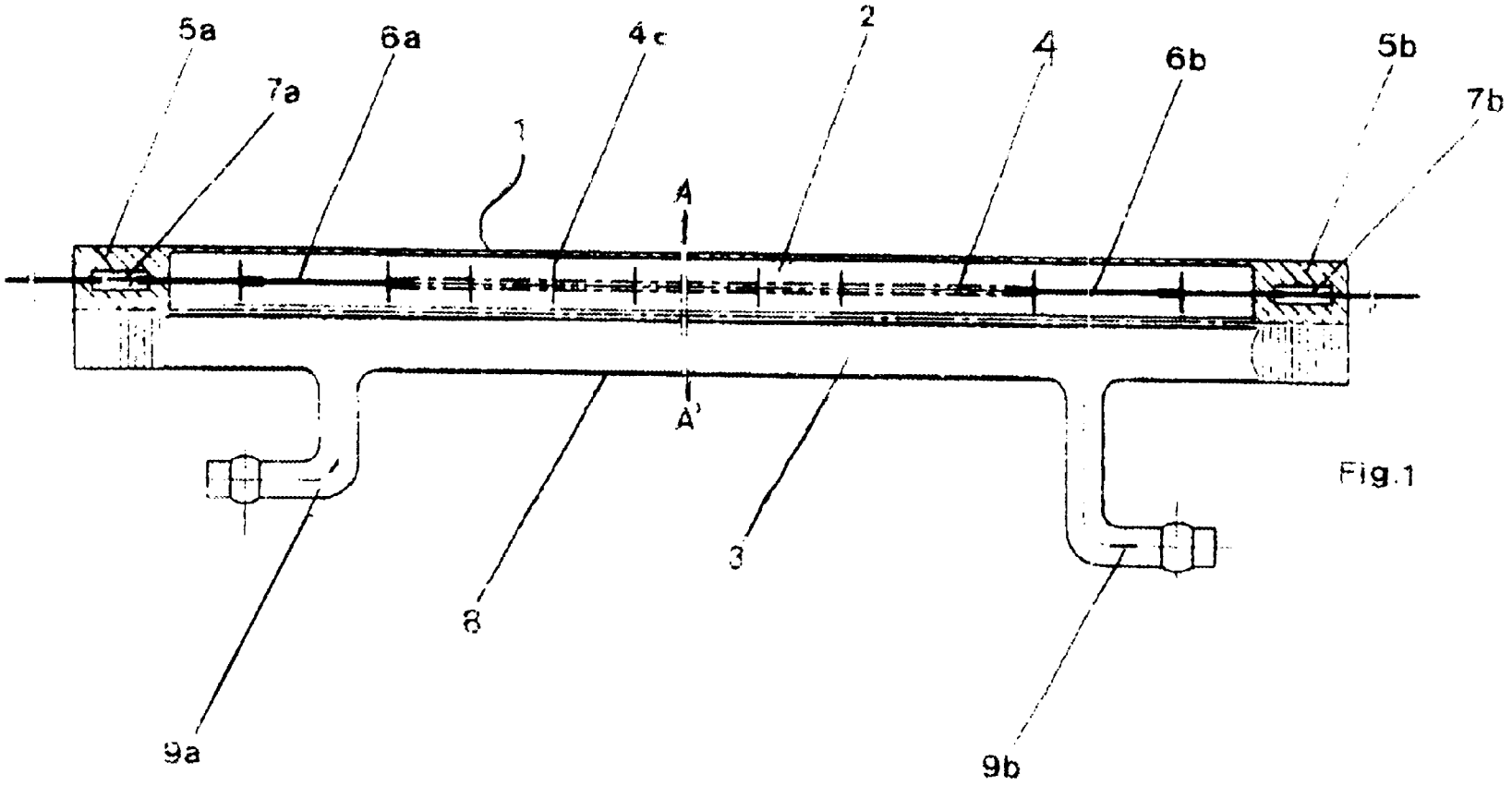
FIG. 1 shows an infrared radiator element with a heating tube, a cooling tube, and a coiled tungsten filament as the heating conductor.

FIG. 1 shows an infrared radiator element 1 with a heating tube 2 and a cooling tube 3 of quartz glass. A long, stretched-out electrical heating conductor 4, which is positioned by means of spacers 4*c*, usually made of tungsten, is provided in the heating tube 2. In this case, the heating conductor 4 is made of tungsten, made into a coil, and the heating tube 2 is filled with an inert gas, doped with halogen. Argon has been selected here as the inert gas, which contains ammonium bromide for the halogen doping. Electrical connecting leads 6*a*, 6*b* are provided between the heating conductor 4 and the gas-tight current lead-throughs 5*a*, 5*b* in the ends of the heating tube 2. The diameter of the connecting leads 6*a*, 6*b* is calculated so that each connecting lead 6*a*, 6*b* heats up to a temperature of 600–800° C. at a rated output as a result of electrical resistance. The gas-tight current lead-throughs 5*a*, 5*b* are formed by pinching and/or fusing the quartz glass at both ends of the heating tube 2. In this case a method sufficiently well known to those skilled in the art is used to seal a piece of thin molybdenum foil 7*a*, 7*b* into the glass. The cooling tube 3 has a cooling channel, which is coated with a metallic reflector 8. The reflector 8 can be formed by a thin layer of gold plating on the inside of the cooling tube 3 (see FIG. 1*a*) or by a piece of nonoxidizing metal foil with a reflective surface such as a piece of gold foil, with which the cooling channel is lined (see FIGS. 1*b* and 1*c*). Connectors 9*a*, 9*b* are provided on the cooling tube for connecting the cooling tube 3 to a coolant line. Water is provided as the liquid coolant.

Figure 1A:
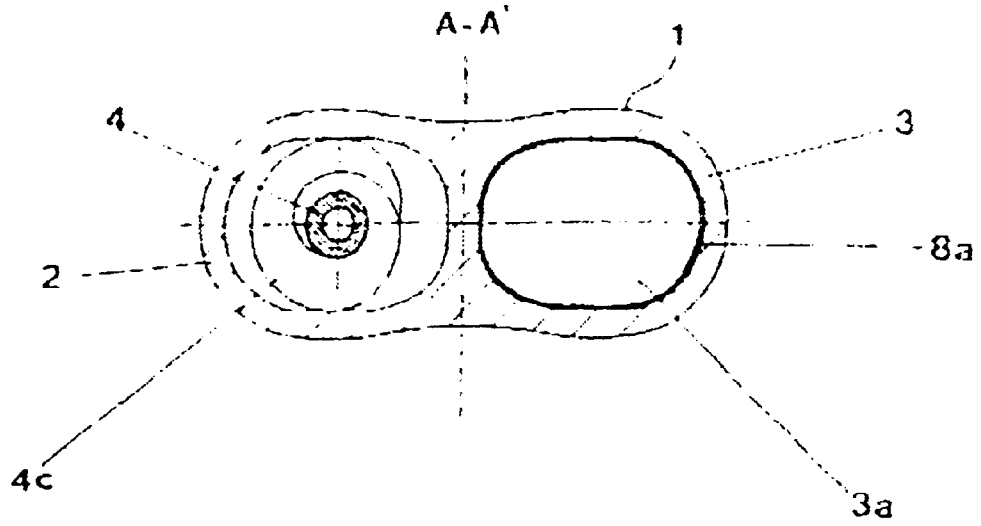
FIG. 1*a* shows a cross section through the infrared radiator element of FIG. 1 with gold plating on the inside of the cooling tube.

FIG. 1*a* shows a cross section A–A' through the infrared radiator element according to FIG. 1 with the heating tube 2 and the cooling tube 3, which has a cooling channel 3*a* for the liquid coolant. In the heating tube 2, the heating conductor 4 is shown in the form of a spiral, which is positioned by means of spacers 4*c*. The cooling tube 3 has a reflector 8*a* in the form of a layer of gold plating on the inside.

Figure 1B:
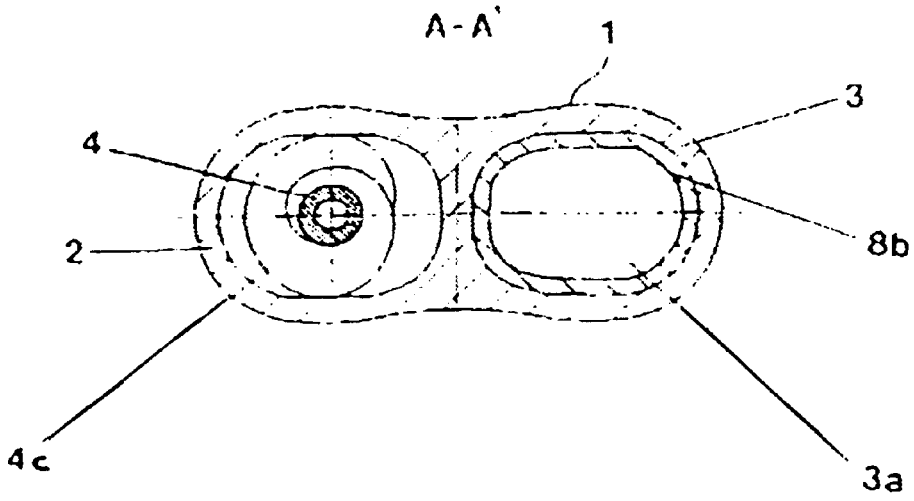
FIG. 1*b* shows a cross section through the infrared radiator element of FIG. 1 with reflective metal foil lining the cooling tube.

FIG. 1*b* shows a cross section A–A' through the infrared radiator element according to FIG. 1 with the heating tube 2 and the cooling tube 3, which has a cooling channel 3*a* for the liquid coolant. In the heating tube 2, the heating conductor 4 is shown in the form of a spiral, which is positioned by means of spacers 4*c*. The cooling tube 3 has a reflector 8*b* in the form of nonoxidizing metal foil with a reflective surface, such as a piece of gold foil, which is in direct contact with the cooling tube 3.

Figure 1C:
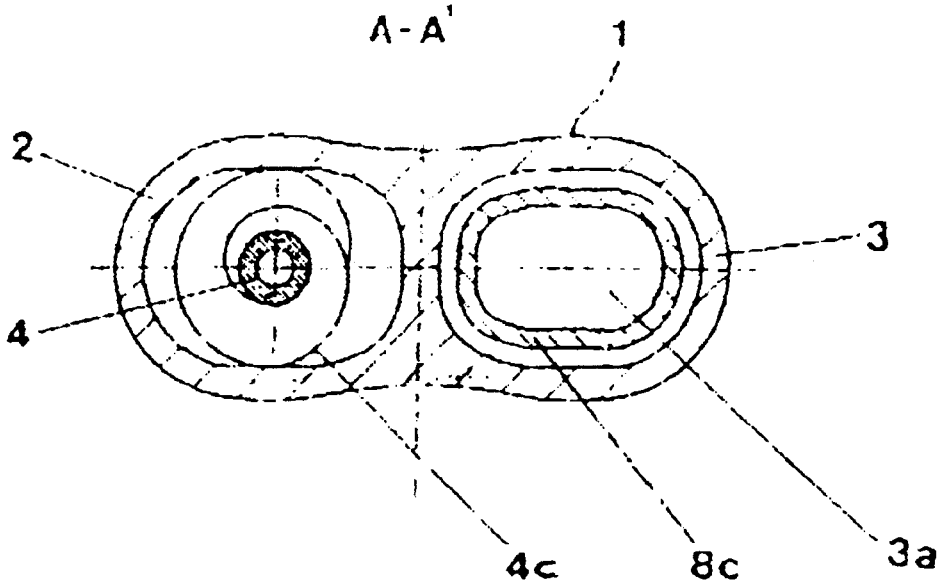
FIG. 1*c* shows a cross section through the infrared radiator element of FIG. 1 with reflective sheet metal lining the cooling tube.

FIG. 1*c* shows a cross section A–A' through the infrared radiator element according to FIG. 1 with the heating tube 2 and the cooling tube 3, which has a cooling channel 3*a* for the liquid coolant. In the heating tube 2, the heating conductor 4 is shown in the form of a spiral, which is positioned by means of spacers 4*c*. The cooling tube 3 has a reflector 8*c* in the form of nonoxidizing sheet metal with a reflective surface, such as a sheet of gold, which is inserted inside the cooling channel 3*a* of the cooling tube 3.

Figure 2:
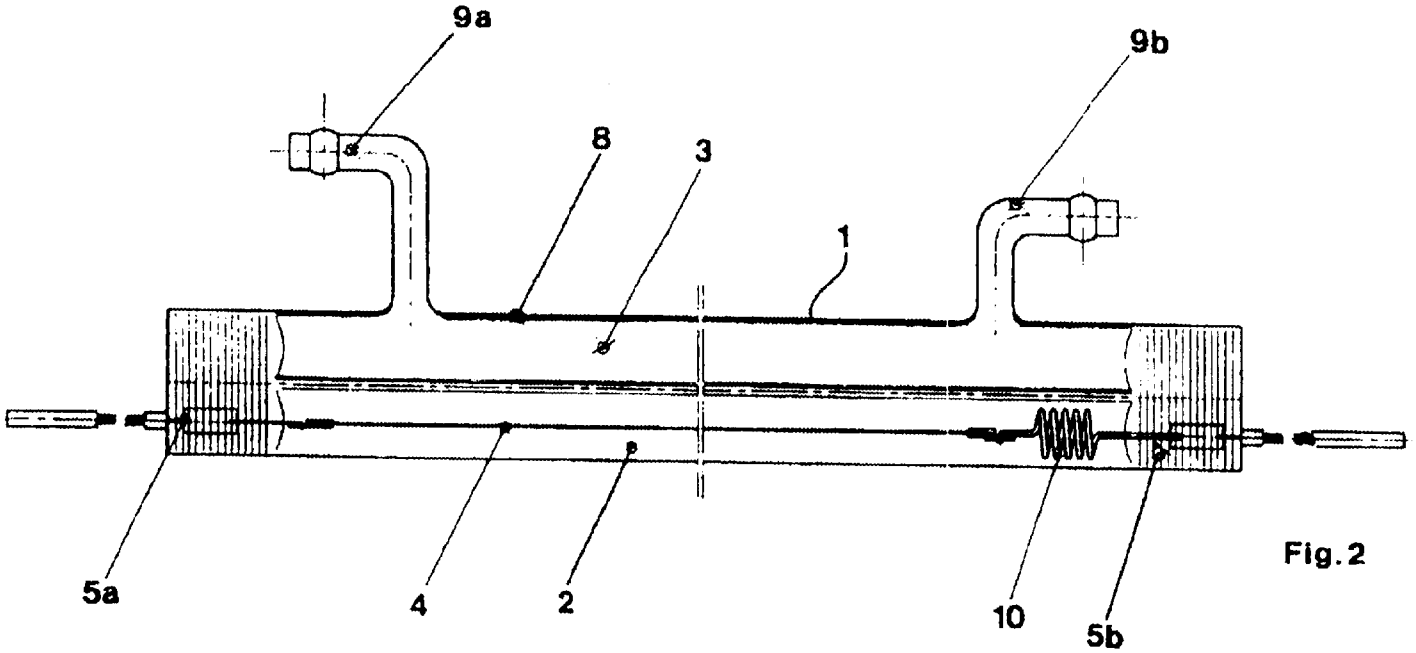
FIG. 2 shows an infrared radiator element with a heating tube, a cooling tube, and a heating conductor designed as a carbon ribbon.
Figure 2A:
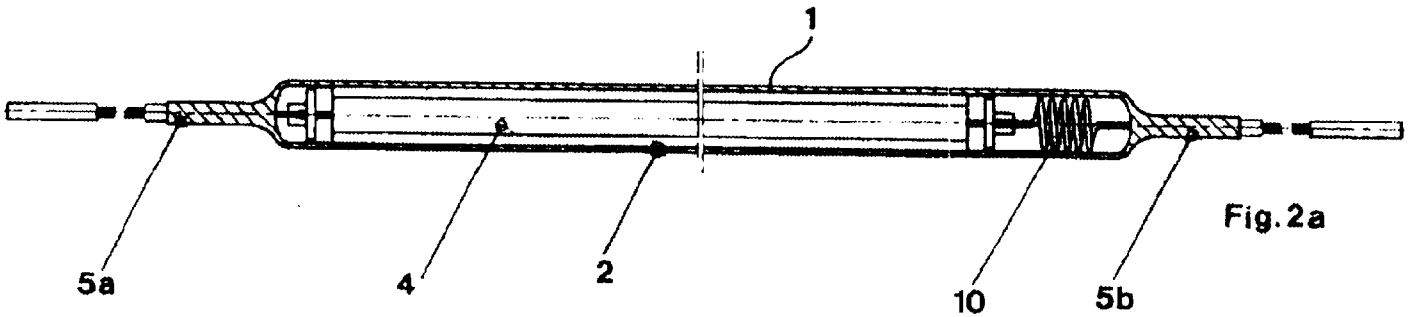
FIG. 2*a* shows a side view of the infrared radiator element of FIG. 2.

FIG. 2 shows an infrared radiator element 1 similar to that of FIG. 1 with a heating tube 2 and a cooling tube 3 of quartz glass. In the heating tube 2 there is a long, stretched-out electrical heating conductor 4, which is held under tension by a spring 10. The heating conductor 4 is designed here as a carbon ribbon, and the heating tube 2 is thus evacuated. The gas-tight current lead-throughs 5*a*, 5*b* are designed as in FIG. 1. The cooling tube 3 has a cooling channel, which is covered by a metallic reflector 8. The reflector 8 can be formed either by a thin layer of gold plating on the inside of the cooling tube 3 (see FIG. 1*a*), by non-oxidizing sheet metal with a reflective surface, such as gold sheet, or by metal foil with a reflective surface, such as gold foil, with which the cooling channel is lined (see FIGS. 1*b* and 1*c*). Connectors 9*a*, 9*b* are provided on the cooling tube 3 to connect the cooling tube 3 to a coolant line. Water is provided as the liquid coolant.

Figure 3A:
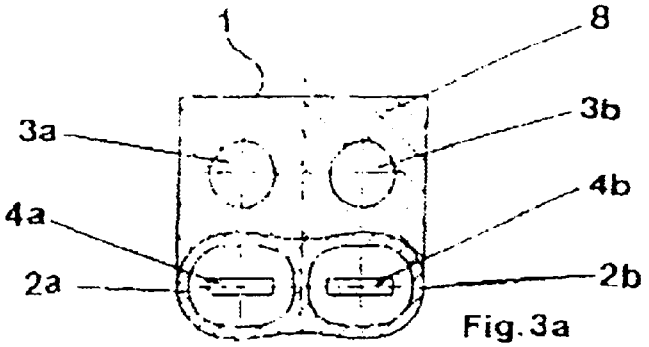
FIG. 3*a* shows a cross section of an infrared radiator element with two heating tubes, two cooling channels, and carbon ribbons as heating conductors.

FIG. 3*a* shows an infrared radiator element 1 in cross section with two quartz glass heating tubes 2*a*, 2*b*, in each of which a heating conductor 4*a*, 4*b* consisting of a carbon ribbon is provided. A metallic reflector 8 is attached in a form-locking manner to one side of each of the two heating tubes 2*a*, 2*b*. In this case, the reflector serves the function not only of a reflector but also of a cooling element at the same time. The reflector 8 has two cooling channels 3*a*, 3*b* for the liquid coolant.

Figure 3B:
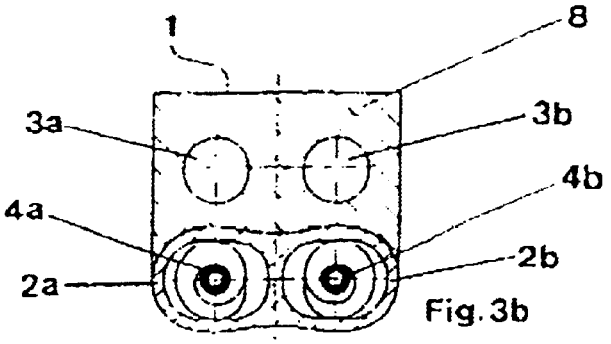
FIG. 3*b* shows a cross section of an infrared radiator element with two heating tubes, two cooling channels, and a coiled tungsten filament as a heating conductor.

FIG. 3*b* shows an infrared radiator element 1 in cross section with two quartz glass heating tubes 2*a*, 2*b*, in each of which a heating conductor 4*a*, 4*b* in the form of a coiled tungsten filament is provided. A metallic reflector 8 is attached in a form-locking manner to one side of each of the two heating tubes 2*a*, 2*b*. In this case, the reflector serves the function not only of a reflector but also of a cooling element at the same time. The reflector 8 has two cooling channels 3*a*, 3*b* for the liquid coolant.

Figure 4A:
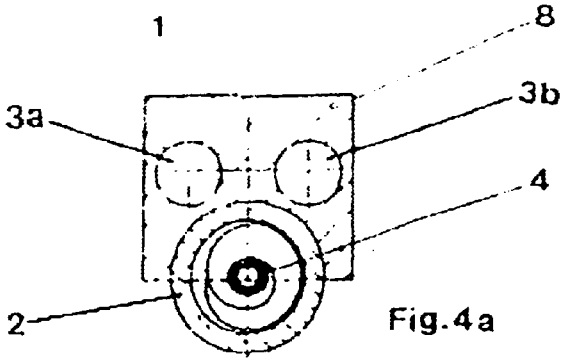
FIG. 4*a* shows a cross section of an infrared radiator element with a heating tube, two cooling channels, and a coiled tungsten filament as a heating conductor.

FIG. 4*a* shows an infrared radiator element 1 in cross section with a quartz glass heating tube 2, in which a heating conductor 4 in the form of a coiled tungsten filament is provided. A metallic reflector 8 is attached in a form-locking manner to one side of the heating tube 2. In this case the reflector serves the function not only of a reflector but also of a cooling element. The reflector 8 has two cooling channels 3*a*, 3*b* for the liquid coolant.

Figure 4B:
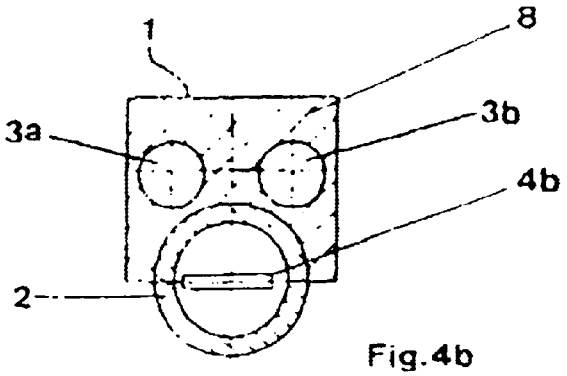
FIG. 4*b* shows a cross section of an infrared radiator element with a heating tube, two cooling channels, and a carbon ribbon as a heating conductor.

FIG. 4*b* shows an infrared radiator element 1 in cross section with a heating tube 2 of quartz glass, in which a heating conductor 4 in the form of a carbon ribbon is provided. A metallic reflector 8 is attached in a form-locking manner to one side of the heating tube 2. In this case the reflector serves the function not only of a reflector but also of a cooling element at the same time. The reflector 8 has two cooling channels 3*a*, 3*b* for the liquid coolant.

Figure 5B:
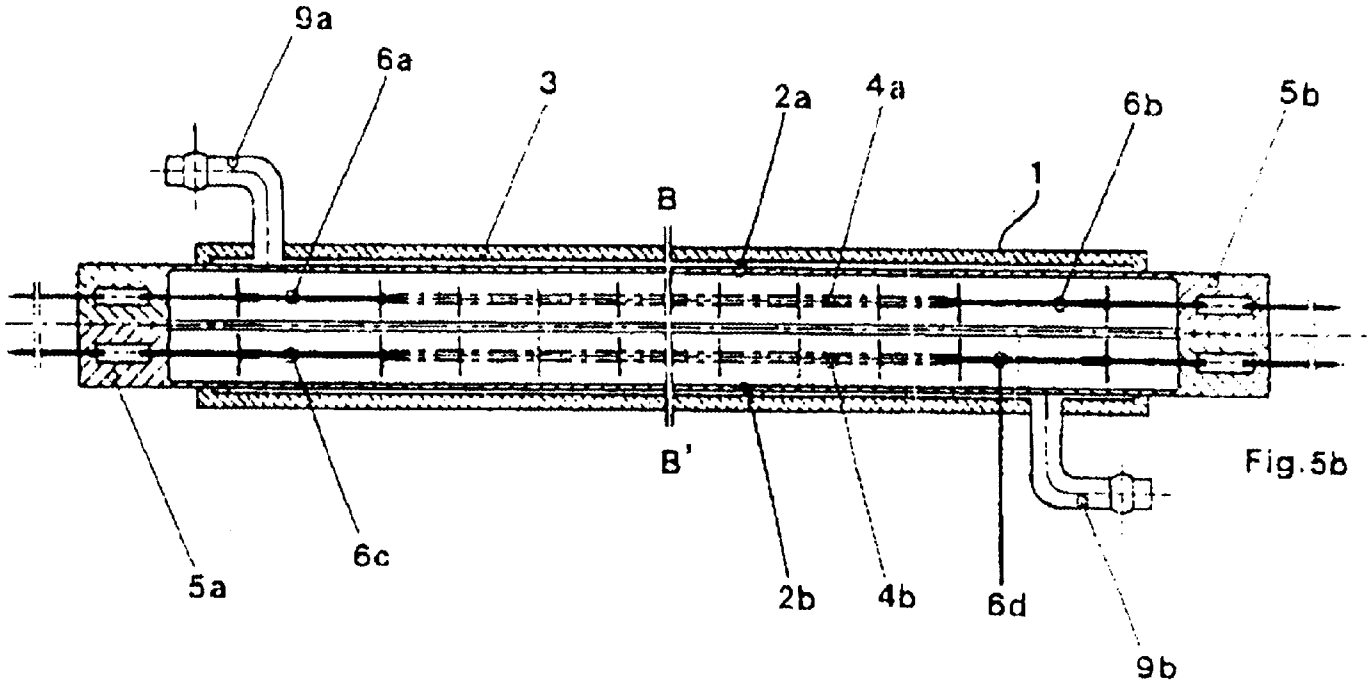
FIG. 5*b* shows a side view of the infrared radiator element of FIG. 5*a;*
Figure 5A:
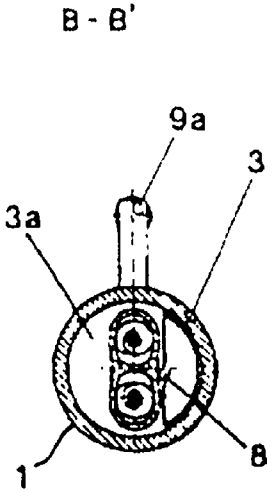
FIG. 5*a* shows a cross section of an infrared radiator with two heating tubes inside a cooling tube and coiled tungsten filaments as heating conductors.

FIG. 5*a* shows an infrared radiator element 1 in cross section B–B' of FIG. 5*b* with two heating tubes enclosing coiled tungsten filaments inside a quartz glass cooling tube 3. The cooling tube 3 has a cooling channel 3*a*, inside which the heating tubes are arranged, and around which therefore a liquid coolant can flow. A metallic reflector 8 is arranged in the cooling channel 3*a* on one side of the heating tubes, which reflector 8 has a hollow, crescent-shaped cross section and through which therefore a coolant can flow. Connectors 9*a* (and 9*b*, see FIG. 5*b*) are provided to connect the cooling tube 3 to a coolant line.

FIG. 5*b* shows the infrared radiator element 1 of FIG. 5*a* in a side view, in which the reflector 8 cannot be seen. The heating tubes 2*a*, 2*b*, however, and the coiled tungsten filaments 4*a*, 4*b* are clearly shown. Between the heating conductors 4*a*, 4*b* and the gas-tight current lead-throughs 5*a*, 5*b* in the ends of the heating tubes 2*a*, 2*b*, electrical connecting leads 6*a*; 6*b*; 6*c*; 6*d* are provided, the diameter of these connecting leads 6*a*; 6*b*; 6*c*; 6*d* being selected in each case so that each connecting lead 6*a*; 6*b*; 6*c*; 6*d* heats up to a temperature of 600–800° C. at a rated output as a result of electrical resistance. The gas-tight current lead-throughs 5*a*, 5*b* are formed by pinching and/or fusing the quartz glass at the two ends of the heating tubes 2*a*, 2*b*. The cooling tube 3 surrounds the two heating tubes 2*a*, 2*b* and can be connected by connectors 9*a*, 9*b* to a coolant line for the coolant.

Figures 6A, 6B, 6C:
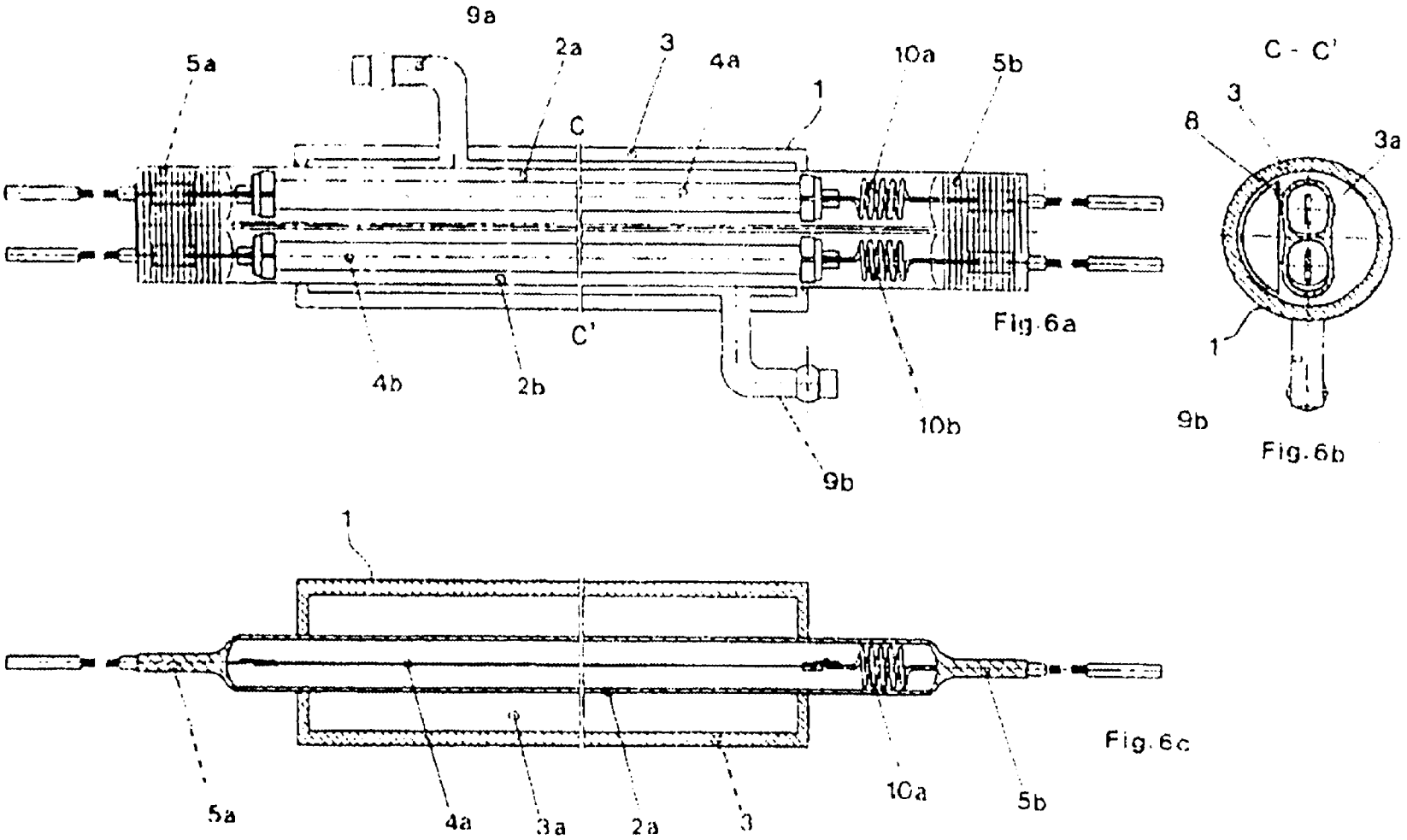
FIG. 6*a* shows a side view of an infrared radiator element with two heating tubes inside a cooling tube.
FIG. 6*b* shows a cross section of the infrared radiator element of FIG. 6*a;*
FIG. 6*c* shows another side view of the infrared radiator element of FIG. 6*a*.

FIG. 6*a* shows an infrared radiator element 1 with two heating tubes 2*a*, 2*b* inside a quartz glass cooling tube 3, which has two connectors 9*a*, 9*b* for the liquid coolant. A heating conductor 4*a*, 4*b* in the form of a carbon ribbon is provided in each of the two heating tubes 2*a*, 2*b*, which ribbons are held under tension by springs 10*a*, 10*b*. In addition, the heating tubes 2*a*, 2*b* have gas-tight current lead-throughs leads 5*a*, 5*b*.

FIG. 6*b* shows the infrared radiator element of FIG. 6*a* in a cross section C–C', where the reflector 8 with its hollow, crescent-shaped form can be seen in the cooling channel 3*a*. Of course, the reflector 8 can also be designed in some other way; for example, it could be fitted in a form-locking manner to the heating tubes 2*a*, 2*b* and to the cooling tube 3.

FIG. 6*c* shows a longitudinal cross section through the infrared radiator element 1 of FIG. 6*a*. The cooling tube 3 and one of the heating tubes 2*a* situated therein can be seen. The heating conductor 4*a* in the form of a carbon ribbon, which is held under tension by a spring 10*a*, is located in the heating tube 2*a*. In addition, the gas-tight current lead-throughs 5*a*, 5*b* can also be seen. The reflector does not appear in this figure.

Figure 7:
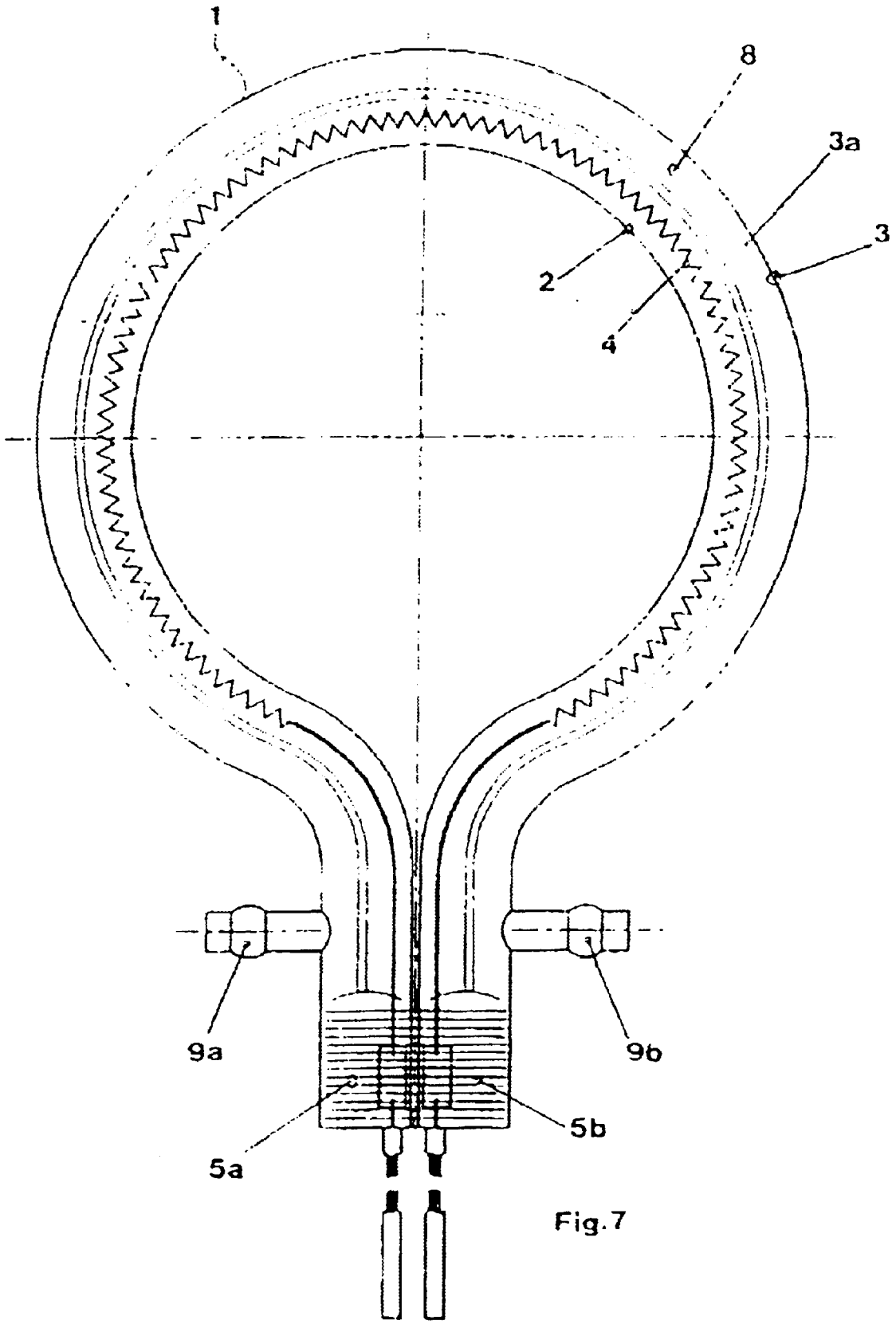
FIG. 7 shows an infrared radiator with curved heating and cooling tubes.

FIG. 7 shows an infrared radiator element 1 with a curved heating tube 2 and a curved cooling tube 3. The two gas-tight current lead-throughs 5*a*, 5*b* of the heating tube 2 point in the same direction and are parallel to each other. To increase the mechanical strength of the arrangement, the current lead-throughs 5*a*, 5*b* can be fused together. A heating conductor 4 in the form of a coiled tungsten filament is installed in the heating tube 2, whereas the cooling channel 3*a* of the cooling tube 3 is surrounded by a reflector 8 in the form of internal gold plating. Connectors 9*a*, 9*b* are provided to connect the cooling tube 3 to a coolant line.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention.

For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A coolable infrared radiator element of quartz glass, comprising:

at least one heating tube, which has a gas-tight current lead-through at each of its two ends;

a long, stretched-out electrical heating conductor provided in the heating tube to serve as a radiation source;

at least one cooling element, which has at least one cooling channel for a liquid coolant; and a metallic reflector in a region of the heating conductor, the metallic reflector having at least one reflective surface which, when seen in a cross section transverse to a longitudinal axis of the tube, describes a closed line completely around a surface of the cooling element, an opening for passage of at least some of the liquid coolant through the metallic reflector being provided in a region of this surface.

2. An infrared radiator element according to claim 1, wherein the reflector is a layer of metal and the cooling element is a cooling tube with at least one cooling channel directly adjacent to the heating tube, the at least one cooling channel being lined with the metal layer.

3. An infrared radiator element according to claim 1, wherein the reflector is a thin-walled piece of metal and the cooling element is a cooling tube with at least one cooling channel directly adjacent to the heating tube, the cooling channel being lined with the metal piece.

4. An infrared radiator element according to claim 1, wherein the reflector is a thin-walled metal part and the cooling element is a cooling tube surrounding the at least one heating tube, the thin-walled metal part being inserted into the cooling tube.

5. An infrared radiator element according to claim 1, wherein the cooling element is a metallic reflector that encloses no more than 50% of a circumference of a outer wall of the at least one heating tube.

6. An infrared radiator element according to claim 5, wherein the reflector has at least two cooling channels for transporting the coolant.

7. An infrared radiator according to claim 1, wherein the heating conductor consists of tungsten, and the heating tube is filled with an inert gas doped with a halogen.

8. An infrared radiator according to claim 7, wherein the halogen doping agent is one of ammonium bromide and copper bromide.

9. An infrared radiator element according to claim 7, and further comprising an electrical connecting lead provided between the heating conductor and each of the gas-tight current lead-throughs, the connecting lead having a diameter so that the connecting lead heats up to a temperature of about 600° to about 800° C. at a rated output as a result of its electrical resistance.

10. An infrared radiator element according to claim 1, wherein the heating conductor is a carbon ribbon and the heating tube is filled with a noble gas.

11. An infrared radiator element according to claim 1, wherein the heating conductor is a carbon ribbon and the heating tube is evacuated.

12. An infrared radiator element according to claim 1, wherein a first and a second heating tube are present, a part of a wall surface of the first heating tube is simultaneously a wall surface of the second heating tube.

13. An infrared radiator element according to claim 1, wherein the heating tube and the cooling element are curved.

14. An infrared radiator element according to claim 13, wherein the two-gas-tight current lead-throughs of the heating tube point in a common direction and are parallel to each other.

15. An infrared radiator element according to claim 1, wherein the heating tube has an inside diameter of about 10 to about 17 mm.

16. An infrared radiator element according to claim 15, wherein the heating conductor is coiled and has a coil diameter so that a ratio of the coil diameter to an inside diameter of the heating tube is at least 1:3.

* * * * *